United States Patent [19]

Gutman

[11] 3,982,740

[45] Sept. 28, 1976

[54] CLAMPING DEVICE

[76] Inventor: David Gutman, 503 Reed St., Philadelphia, Pa. 19147

[22] Filed: June 20, 1975

[21] Appl. No.: 588,982

Related U.S. Application Data

[63] Continuation of Ser. No. 347,053, April 2, 1973, abandoned.

[52] U.S. Cl. ..... 269/110; 269/154; 269/155

[51] Int. Cl.[2] ..... B25B 5/16

[58] Field of Search ..... 269/88, 110, 127–129, 269/134, 135, 136, 156, 271, 280, 282, 164, 265, 266, 267

[56] References Cited

UNITED STATES PATENTS

| | | | |
|---|---|---|---|
| 893,875 | 7/1907 | Schneider | 269/154 X |
| 1,194,666 | 8/1916 | Romanowski | 269/110 |
| 1,522,141 | 1/1925 | Raby | 269/267 |
| 1,674,291 | 6/1928 | Malone | 269/110 |
| 1,730,510 | 10/1929 | Jensen | 269/164 |
| 2,364,150 | 12/1944 | Lowenstein | 269/155 X |

FOREIGN PATENTS OR APPLICATIONS

| | | | |
|---|---|---|---|
| 338,664 | 3/1936 | Italy | 269/88 |

*Primary Examiner*—Al Lawrence Smith
*Assistant Examiner*—Robert C. Watson
*Attorney, Agent, or Firm*—Morton J. Rosenberg

[57] ABSTRACT

A clamping device adapted for use in combination with a vise to maintain a workpiece in fixed relation to the vise when being worked on. The clamping device includes a plate member which is forced downwardly on the workpiece which is being held between the jaws of the vise. The plate member is threadedly mounted to the opposing vise jaws through a pair of transversely opposed screw members. A pair of thumbscrews or lock washers threadedly engage the screw members and interface with an upper surface of the plate member to force it against the captured workpiece.

6 Claims, 9 Drawing Figures

FIG. 4
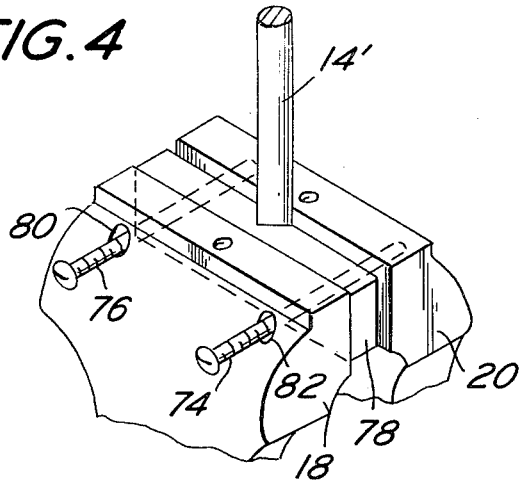
FIG. 5
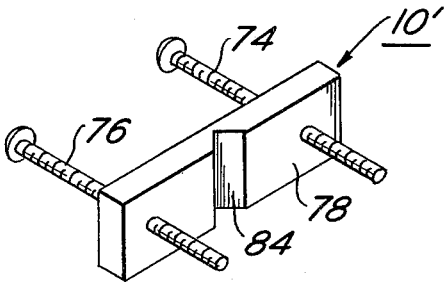
FIG. 6
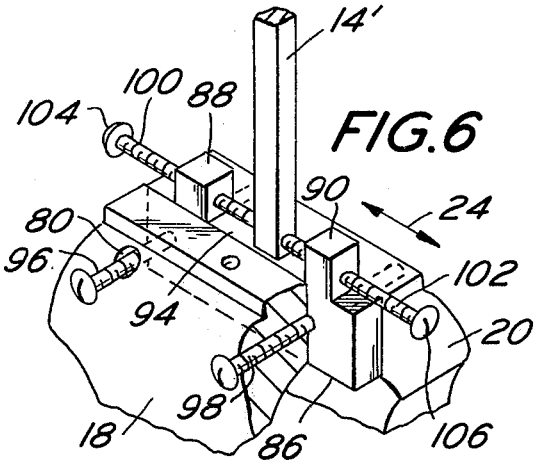
FIG. 7
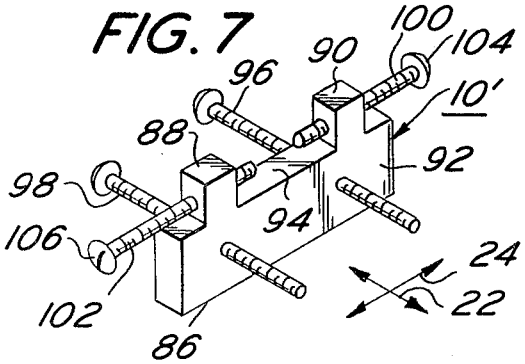
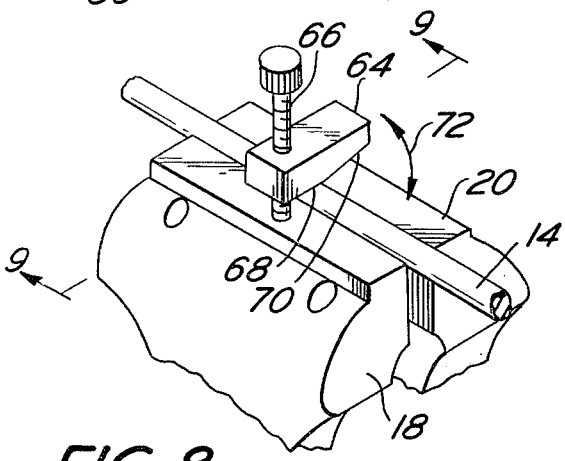
FIG. 8
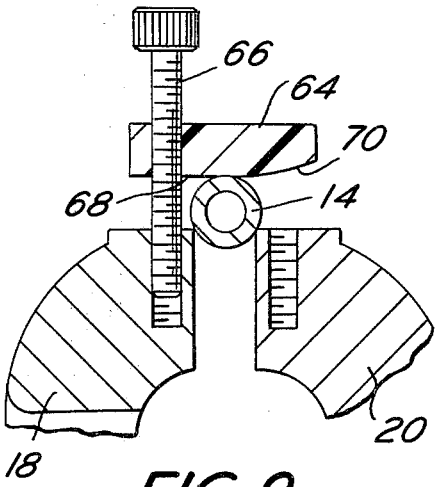
FIG. 9

CLAMPING DEVICE

This is a continuation of application Ser. No. 347,053, filed Apr. 2, 1973, now abandoned.

BACKGROUND OF THE INVENTION

1. Field of the Invention

This invention pertains to the field of clamping devices. In particular, this invention relates to the field of clamping attachments for vises.

2. Prior Art

Clamping devices for aiding an operator to fixedly restrain workpieces having other than flat edges in a vise are known in the art. However, some of these prior devices provide only a V-block wedge within the workpiece may rest. Such does not allow a wide range of geometrical contours to be worked on. Other devices provide circular inserts within which circular workpieces may be maintained. However, such inserts are only workable on a limited number of workpiece diameters.

In other devices, the workpiece is only restrained by the compressive action of the vise jaws. Where the workpiece has an irregular contour, the jaws may have to be closed to a position which may damage the workpiece.

Other prior devices provide a cradle within which the workpiece is placed. However, such cradles do not provide a positive clamping force on the workpiece and thus it is still free to move when being worked on. Thus in such devices, the main restraining force is still provided by the vise jaws leading to damage of the workpiece when the jaws are compressively actuated against the workpiece.

SUMMARY OF THE INVENTION

A clamping device adapted for use in combination with a vise. The vise has a pair of transversely displaceable vise jaws for gripping a longitudinally disposed workpiece between the clamping device and the vise jaws. The clamping device comprises a contracting mechanism for contacting the workpiece in a downward direction between the vise jaws. The vise jaws are in transverse contact with the workpiece and the contacting mechanism is removeably secured to at least one of the vise jaws.

BRIEF DESCRIPTION OF THE DRAWINGS

FIG. 4 is a perspective view of an embodiment of the invention in combination with vise jaws for holding a vertically extending workpiece;

FIG. 5 is a perspective view of the embodiment of the invention of FIG. 4, showing the V-block attachment to the vise jaws;

FIG. 6 is a perspective view of an embodiment of the invention for holding vertically extending workpieces taken in combination with the vise jaws;

FIG. 7 is a perspective view of the embodiment of the invention as shown in FIG. 6;

FIG. 8 is a perspective view of an embodiment of the invention applicable for quick connection or disconnection onto the workpiece; and, FIG. 9 is a cross-sectional view of the embodiment of the invention taken along the section line 9—9 of FIG. 8.

DESCRIPTION OF THE PREFERRED EMBODIMENTS

Figure 1:
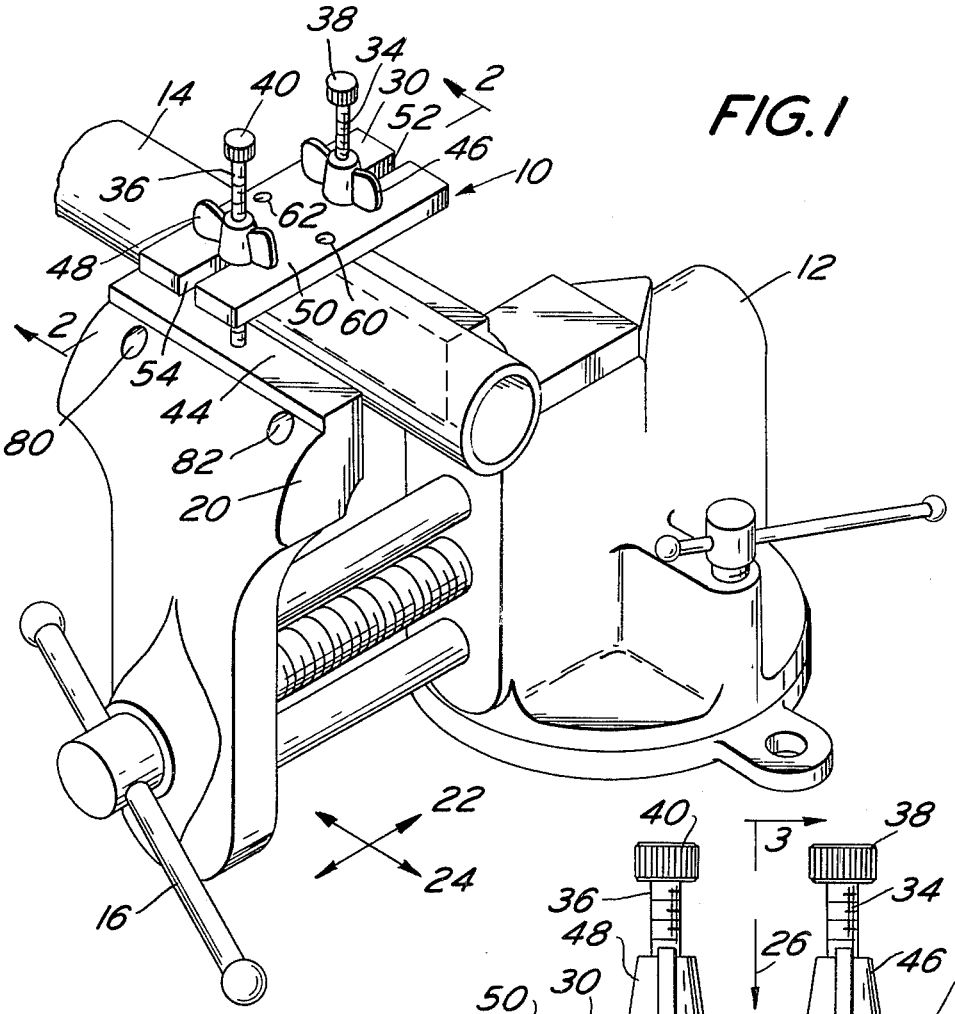
FIG. 1 is a perspective view of a vise in combination with the clamping device holding a tubular workpiece in fixed restrainment.
Figure 2:
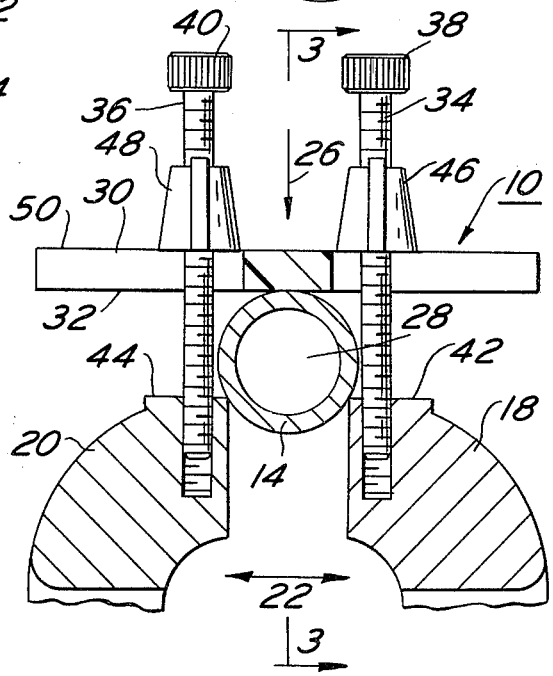
FIG. 2 is a sectional view of the clamping device and vise jaws taken in relation to the secured workpiece along section lines 2—2 of FIG. 1.
Figure 3:
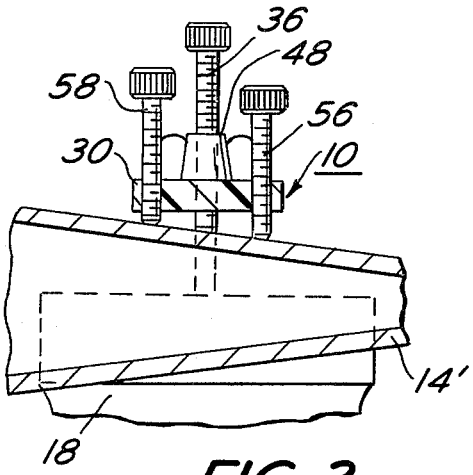
FIG. 3 is a side view of the clamping device holding a tapered workpiece.

Referring now to the invention, FIGS. 1, 2, and 3 show clamping device or vise jig 10 adapted for use in combination with vise 12. Clamping or gripping mechanism 10 is used to increase the holding force applied to workpiece 14 thereby maintaining workpiece 14 in a relatively immovable position when work forces such as filing, sawing, drilling or like techniques are being applied.

Vise 12 is of standard construction and is mounted to a base surface (not shown). Rotatable handle 16 actuates a pair of vise jaws 18, 20 for movement in transverse direction 22. Jaws 18, 20 may both be moveable or one may be translatable with respect to the other. Movement and specific structural considerations of standard vise 12 are not important to the inventive concept as herein detailed with the exception being that jaws 18 and 20 are so constructed as to compressively hold workpiece 14 between them as is shown in FIGS. 1 and 2.

Workpiece 14 extends in a direction defined by longitudinally directed arrow 24. As is seen in FIGS. 1, 2, and 3 workpiece 14 or 14' is shown as having a cylindrical cross-sectional area, however, it must be understood that device 10 is applicable to a wide range of geometrical contours for workpiece 14 and 14'. As will be described in the following paragraphs, clamping device 10 operates on the principle of providing a downward force defined by directional arrow 26, shown in FIG. 2, in combination with transversely directed compressive forces supplied by vise jaws 18, 20 all acting on workpiece 14.

Workpiece 14 is inserted within the transverse opening provided by the displacement of jaws 18, 20. Workpiece 14 is further positionally located in a manner such that it passes in a substantially longitudinal direction 24. As is shown in FIG. 2, vise jaws 18, 20 contact opposing sides of workpiece 14 below the workpiece area center 28 in order that downward force 26 will aid in wedging workpiece 14 between opposing jaws 18 and 20. The combination of these forces on workpiece 14 provide a positive friction grip along at least three lines of contact to materially maintain workpiece 14 in fixed restrainment while being operated upon.

Clamping device 10, defining a workpiece contacting mechanism includes plate member 30 which interfaces with workpiece 14 on plate lower surface 32. As will be seen, plate member 30 is releaseably secured to vise jaws 18, 20 in order to permit removal of device 10 from vise 12. Plate 30 passes in transverse direction 22 across the opening distance between jaws 18 and 20. In construction, plate element 30 may be formed of steel, aluminum, plastic or in general any solid material capable of maintaining workpiece 14 in constrained relation with respect to vise jaws 18 and 20. As is shown in the figures, plate 30 is generally rectangular in cross-section, however, such is not important to the inventive concept as is herein detailed. The only restriction on the geometrical contour of plate 30 being that such include lower surface 32 which may form a force line at the interface between device 10 and workpiece 14.

Plate member 30 is mounted to vise jaws 18 and 20 through securing mechanisms 34 and 36. Mechanisms 34 and 36 may be screws or threaded bolts for threadedly engaging jaws 18 and 20 as is shown in FIG. 2. Screws 34, 36 are aligned with respect to each other in transverse direction 22. Threaded bolts or screws 34, 36 may include insertion knobs 38, 40 for manually inserting elements 34, 36 into threaded holes formed through vise jaw upper surfaces 42, 44. As will be understood, knobs 38 and 40 may be standard screw heads wherein a screwdriver may be employed to threadedly engage members 34 and 36 to jaws 18 and 20.

Plate member 30 is maintained in releasable securement with workpiece 14 through action of threaded securing mechanisms 46, 48. Securing mechanisms 46 and 48 may be thumbscrews (as shown in FIGS. 1, 2 and 3), lock washers, nuts or other like members. Elements 46 and 48 threadedly engage screws 34 and 36 respectively and are freely moveable thereon. In operation, threaded securement elements 46, 48 are brought into contact with plate member upper surface 50 in order to cause an interface between lower surface 32 and workpiece 14. Elements 46, 48 provide a necessary downward force on workpiece 14 to wedge it securely between displaced jaws 18 and 20.

In order to provide applicability of device 10 to a wide range of workpiece 14 width sizes, transverse adjustment recesses 52, 54 are formed in plate member 30 as is shown in FIG. 1. Recesses 52, 54 pass through plate 30 and are directed in transverse direction 22 throughout a portion of the transverse length of plate 30. Recesses 52 and 54 have a width in excess of the diameter of screw members 34, 36 to allow free passage of screws 34, 36 within recesses 52, 54. In this way, jaws 18 and 20 may be opened to varying width displacements to accommodate a workpiece 14' which may be tapered in longitudinal direction 24, taper securement elements 56, 58 are provided as shown in FIG. 3. Openings 60, 62 are vertically passed through plate member 30 and tapped to accommodate taper securing screws 56, 58. Threaded openings 60, 62 and screws 56, 58 are aligned and displaced from each other in longitudinal direction 24. Screws 56 and 58 may thus engage an upper surface of workpiece 14' at differing heights in order to maintain workpiece 14' in secured relation to vise jaws 18, 20.

An embodiment of the present invention is shown in FIGS. 8 and 9 for use with workpieces 14 having a small diameter. In this form of the invention, plate or rod element 64 is threadedly or otherwise secured to screw member 66. Screw member 66 threadedly engages one of vise jaws 18 or 20 as is shown. Lower rod surface 68 is brought into contact with workpiece 14 in order to provide the necessary downward force to wedge workpiece between jaws 18 and 20. Tapered surface 70 permits plate element 64 to be removed from contact with workpiece 14 in one-quarter of a rotary turn as shown by double-headed arrow 72. In this manner, a series of similarly shaped workpieces may be quickly interchanged between jaws 18 and 20.

Another embodiment of the present invention is shown in FIGS. 4 and 5 where clamping device 10' is used for holding irregularly shaped workpieces 14' in vertical compression with respect to vise jaws 18 and 20. In this embodiment a pair of screws or threaded bolt members 74, 76 are mounted to V-block member 78 through tapered securement or other fixed means. Members 74, 76 pass through openings 80, 82 of jaws 18, 20 as shown in FIGS. 1 and 4. Openings 80, 82 pass completely through each of vise jaws 18, 20 being directed in transverse direction 22. Bolts 74, 76 have a diameter smaller than the diameters of openings 80, 82 for ease in passing members 74, 76 completely through jaws 18, 20. V-block member 78 includes V-shaped recess 84 passing in a substantially vertical direction as shown in FIG. 5.

In operation, V-block member 78 is inserted between vise jaws 18, 20. A back surface of block member 78 is interfaced with an inner surface of one of jaws 18 or 20. In this position V-recess 84 faces the opposing jaw 18 or 20. Openings formed through block member 78 are aligned with through passages 80, 82 and screw members 74, 76 are passed therein. Bolt members 74, 76 are then passed through openings 80 and 82 on the opposing vise jaw 18 or 20 to provide releaseable securement between clamping device 10' and vise 12. Workpiece 14' is inserted within V-recess 84, and vise jaws 18 and 20 are moveably displaced toward each other. Workpiece 14' is compressively loaded by jaws 18 and 20 and it is held in fixed relation within V-recess 84.

Another embodiment for holding workpiece 14' in vertical relation to vise jaws 18, 20 is shown in FIGS. 6 and 7. This embodiment of clamping device 10' is adapted to the holding of a vertically oriented workpiece 14' (as shown in FIG. 6). Device 10' includes plate member 86 which is releaseably secured to vise jaws 18 and 20 as shown in FIG. 6. Plate member 86 may be constructed in one piece formation and includes a pair of vertically oriented legs 88, 90 formed on base member 92. Legs 88 and 90 are displaced each from the other in longitudinal direction 24 and interfaces with base member 92 on base surface 94. This geometrical contour gives plate member 86 an overall U-shaped contour.

Transversely directed screw members 96, 98 pass through plate member 86 as shown. Screw members 96, 98 are releaseably secured to plate 86 by threaded interface or some like means. Additionally, screw members 96 and 98 pass through longitudinally displaced holes or openings 80 and 82 which have a diameter slightly in excess of the diameter of screw members 96 and 98. However, it should be understood that holes 80 and 82 may be threaded to permit threaded interface between screw members 96, 98 and holes 82 and 80. In positional location, as shown in FIG. 6, plate member 86 is inserted between vise jaws 18 and 20. Screw members 96 and 98 are passed through openings 80 and 82 respectively of one of vise jaws 18 or 20 and engage plate member 86. Screws or bolts 96, 98 are then passed through the other vise jaw 18 or 20 to loosely mount plate member 86 between vise jaws 18 and 20.

Opposing longitudinally directed threaded members 100 and 102 threadedly engage legs 90 and 88 as is shown in FIG. 7. Threaded members 100 and 102 may be rotated to longitudinally displace themselves from each other through rotation of respective head elements 104, 106 respectively. In operation, device 10' is positionally located with respect to vise jaws 18 and 20 as is shown in FIG. 6. Workpiece 14' is placed onto base surface 94 in a substantially vertical orientation as is shown.

Longitudinally directed members 100 and 102 are rotationally actuated to grip workpiece 14' on opposing surfaces. Vise jaws 18 and 20 may then be displaced in transverse direction 22 toward each other until they grip workpiece 14' on opposing sides in order to cause workpiece 14' to be gripped in a four point contact. This increases the gripping force on workpiece 14' to permit operations to be concluded thereon.

The invention as herein described has been shown to be an effective clamping device which considerably adds to the gripping force exerted on workpieces being held in vises or similar structures. The clamping device provides increased gripping contact on a wide variety of workpiece geometries (especially unorthodox geometries) and workpieces which are maintained in different orientations with respect to the vise jaws. While the invention has been described with certain specific embodiments thereof, it will now be understood that further modifications will suggest themselves to those skilled in the art, and it is intended to cover such modifications within the scope of the appended claims.

What is claimed is:

1. A clamping device for gripping a longitudinally disposed work piece comprising:

a. a vise having a pair of transversely displaceable vise jaws, each of said vise jaws having longitudinally extending upper and side surfaces, said upper and side surfaces being orthogonal each to the other for contacting said workpiece along an interface line of said upper and side surfaces;

b. means for contacting said work piece in a downward direction between said vise jaws in transverse contact with said work piece, said contacting means being singularly planar in contour for contacting said work piece along only one line of contact, said vise jaws and said contacting means having load contact with said work piece along three lines of contact, said three lines of load contact forming three load point contacts in a plane normal to said longitudinally disposed work piece, said point load contacts between each of said displaceable vise jaws and said contacting means having an angular displacement greater than a right angle, said contacting means being removeably secured to each of said vise jaws, the portion of the work piece between said vise jaws being unsupported, said vise jaws being displaced each from the other in said transverse direction to provide a work area on said work piece opposing said contacting means; and, c. transverse adjustment means formed through said contacting means for allowing transverse displacement of said vise jaws and removal of said contacting means from cooperative relation with said vise jaws.

2. The clamping device as recited in claim 1 where said vise jaws contact said work piece on opposing transverse sides thereof in a manner such that a combined upwardly directed and transversely directed pair of forces are applied to said work piece from said vise jaws along an edge line of each of said vise jaws.

3. The clamping device as recited in claim 1 where said contacting means includes plate means releaseably secured to said vise jaws, said plate means having a substantially planar flat contour and passing in said transverse direction for contacting said work piece along a longitudinally directed contact line to wedge said work piece between edge lines of said vise jaws.

4. The clamping device as recited in claim 3 including means for securing said plate means to said work piece and said vise jaws, said securing means being threadedly engageable with said vise jaws for providing interelated contact forces between said vise jaws, said plate means and said work piece.

5. The clamping device as recited in claim 4 where said securing means includes:

a. a pair of screws for threadedly engaging each of said vise jaws; and, b. threaded securement means for threadedly engaging said screws, said threaded securement means being adapted to apply a force on an upper surface of said plate means for contacting said work piece on a lower surface of said plate means.

6. The clamping device as recited in claim 3 where said plate means includes transverse adjustment means for providing a multiplicity of width openings of said vise jaws for accommodating differing width sizes of said work piece.

* * * * *